US008478513B1

(12) United States Patent
Kar et al.

(10) Patent No.: US 8,478,513 B1
(45) Date of Patent: Jul. 2, 2013

(54) SYSTEM AND METHOD FOR DISPLAYING DEGRADED TRAFFIC DATA ON AN IN-TRAIL PROCEDURE (ITP) DISPLAY

(75) Inventors: Satyanarayan Kar, Karnataka (IN); Jitender Kumar Agarwal, UttarPradesh (IN); Sanjib Kumar Maji, Karnataka (IN); Sandeep Chakraborty, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/354,777

(22) Filed: Jan. 20, 2012

(51) Int. Cl.
*G06G 7/76* (2006.01)

(52) U.S. Cl.
USPC ..... 701/120

(58) Field of Classification Search
USPC ..... 701/3–5, 120
See application file for complete search history.

(56) References Cited

U.S. PATENT DOCUMENTS

| | | | | |
|---|---|---|---|---|
| 3,875,379 | A | 4/1975 | Vietor | |
| 5,077,673 | A | 12/1991 | Brodegard et al. | |
| 5,574,647 | A | 11/1996 | Liden | |
| 5,957,412 | A | 9/1999 | Saint Upery et al. | |
| 6,085,145 | A | 7/2000 | Taka et al. | |
| 6,127,944 | A | 10/2000 | Daly et al. | |
| 6,148,259 | A | 11/2000 | Hagelauer | |
| 6,433,729 | B1 * | 8/2002 | Staggs | 342/29 |
| 6,469,660 | B1 * | 10/2002 | Horvath et al. | 342/179 |
| 6,690,298 | B1 | 2/2004 | Barber et al. | |
| 6,696,980 | B1 | 2/2004 | Langner et al. | |
| 6,711,479 | B1 * | 3/2004 | Staggs | 701/16 |
| 6,720,891 | B2 | 4/2004 | Chen et al. | |
| 6,799,114 | B2 | 9/2004 | Etnyre | |
| 6,816,780 | B2 | 11/2004 | Naimer et al. | |
| 6,828,921 | B2 | 12/2004 | Brown et al. | |
| 6,839,018 | B2 | 1/2005 | Szeto et al. | |
| 6,876,906 | B1 | 4/2005 | Zellers et al. | |
| 6,946,976 | B1 | 9/2005 | Langner et al. | |
| 6,963,291 | B2 | 11/2005 | Holforty et al. | |
| 7,103,455 | B2 | 9/2006 | Subelet | |
| 7,366,591 | B2 | 4/2008 | Hartmann et al. | |

(Continued)

FOREIGN PATENT DOCUMENTS

| | | | |
|---|---|---|---|
| EP | 1752739 | A2 | 2/2007 |
| EP | 1752739 | A3 | 1/2008 |
| EP | 1947624 | A1 | 7/2008 |
| EP | 2071542 | A2 | 6/2009 |
| EP | 2345872 | A2 | 7/2011 |
| FR | 2898675 | A1 | 3/2006 |
| FR | 2910124 | A1 | 12/2006 |

OTHER PUBLICATIONS

Haissig et al, C.M. Using TCAS Surveillance to Enable Legacy ADS-B Transponder Use for In-Trail Procedures, 2012, IEEE/AIAA 31st Digital Avionics Systems Conference, 2012, pp. 1-12.*

(Continued)

*Primary Examiner* — Russell Frejd
(74) *Attorney, Agent, or Firm* — Ingrassia Fisher & Lorenz, P.C.

(57) ABSTRACT

A system and method for displaying degraded traffic data from an intruder aircraft on an ITP display is provided. The method includes determining if the degraded traffic data exhibits navigational accuracy sufficient for display on the ITP display, and analyzing the degraded traffic data to determine the ITP parameters for similar track traffic and to determine if the navigational accuracy of the degraded traffic data is within predefined bounds if the navigational accuracy of the degraded traffic is not sufficient for display on the ITP display.

20 Claims, 7 Drawing Sheets

U.S. PATENT DOCUMENTS

| | | | | |
|---|---|---|---|---|
| 7,367,526 | B2 | 5/2008 | Baudry | |
| 7,375,678 | B2 | 5/2008 | Feyereisen et al. | |
| 7,386,373 | B1 | 6/2008 | Chen et al. | |
| 7,403,843 | B2 | 7/2008 | Gremmert | |
| 7,453,375 | B2 | 11/2008 | Chamas et al. | |
| 7,471,995 | B1 | 12/2008 | Robinson | |
| 7,570,178 | B1 * | 8/2009 | Whalen et al. | 340/961 |
| 7,650,232 | B1 | 1/2010 | Paielli | |
| 7,746,343 | B1 | 6/2010 | Charaniya et al. | |
| 7,747,382 | B2 | 6/2010 | Small et al. | |
| 7,877,197 | B2 | 1/2011 | Lewis et al. | |
| 7,961,135 | B2 | 6/2011 | Smith et al. | |
| 7,965,223 | B1 | 6/2011 | McCusker | |
| 8,271,152 | B2 | 9/2012 | Singer et al. | |
| 2002/0075171 | A1 | 6/2002 | Kuntman et al. | |
| 2002/0089432 | A1 | 7/2002 | Staggs et al. | |
| 2002/0133294 | A1 | 9/2002 | Farmakis et al. | |
| 2006/0290562 | A1 | 12/2006 | Ehresman | |
| 2008/0065312 | A1 | 3/2008 | Coulmeau et al. | |
| 2008/0266054 | A1 | 10/2008 | Crank | |
| 2008/0288164 | A1 | 11/2008 | Lewis et al. | |
| 2008/0309518 | A1 | 12/2008 | Aung | |
| 2009/0024311 | A1 | 1/2009 | Hess | |
| 2009/0088972 | A1 | 4/2009 | Bushnell | |
| 2009/0231163 | A1 | 9/2009 | He | |
| 2009/0267800 | A1 | 10/2009 | Hammack et al. | |
| 2010/0023187 | A1 | 1/2010 | Gannon et al. | |
| 2010/0070180 | A1 | 3/2010 | Ridenour | |
| 2010/0131121 | A1 | 5/2010 | Gerlock | |
| 2010/0152932 | A1 | 6/2010 | Das | |
| 2010/0286900 | A1 | 11/2010 | Depape et al. | |
| 2010/0292871 | A1 | 11/2010 | Schultz et al. | |
| 2010/0305783 | A1 | 12/2010 | Tucker et al. | |
| 2010/0332054 | A1 | 12/2010 | Brandao et al. | |
| 2011/0006918 | A1 | 1/2011 | Shafaat et al. | |
| 2011/0066360 | A1 | 3/2011 | Haissig | |
| 2011/0066362 | A1 | 3/2011 | He | |
| 2011/0118981 | A1 | 5/2011 | Chamlou | |
| 2011/0187588 | A1 | 8/2011 | Khatwa et al. | |
| 2011/0224847 | A1 | 9/2011 | Singer et al. | |
| 2011/0231096 | A1 | 9/2011 | Ridenour, II | |
| 2011/0270472 | A1 | 11/2011 | Shafaat et al. | |
| 2011/0270473 | A1 | 11/2011 | Reynolds et al. | |
| 2011/0276198 | A1 | 11/2011 | Khatwa et al. | |
| 2011/0282568 | A1 | 11/2011 | Khatwa et al. | |
| 2011/0316857 | A1 | 12/2011 | Pepitone et al. | |
| 2012/0095623 | A1 * | 4/2012 | Barral et al. | 701/4 |
| 2012/0203448 | A1 * | 8/2012 | Pepitone et al. | 701/120 |
| 2013/0006511 | A1 * | 1/2013 | Ramaiah et al. | 701/120 |

OTHER PUBLICATIONS

RTCA, Inc.; Safety, Performance and Interoperability Requirements Document for the In-Trail Procedure in Oceanic Airspace (ATSA-ITP) Application; RTCA/DO-312, Jun. 19, 2008.

EP Search Report, EP 10 166 821.8, dated Apr. 21, 2011.

EP Communication for EP 10 166 821.8 dated Mar. 23, 2011.

USPTO Office Action for U.S. Appl. No. 12/721,146; Notification Date Jan. 9, 2012.

EP Search Report, EP11 154 857.4, dated Apr. 11, 2012.

USPTO Notice of Allowance for U.S. Appl. No. 12/774,513; notification date Dec. 11, 2012.

USPTO Office Action for U.S. Appl. No. 12/563,691; notification date Dec. 9, 2011.

USPTO Final Office Action for U.S. Appl. No. 12/563,691; notification date Mar. 30, 2012.

USPTO Final Office Action for U.S. Appl. No. 13/407,475; notification date Feb. 6, 2013.

Chartrand, R. C. et al.; Operational Improvements From Using the In-Trail Procedure in the North Atlantic Organized Track System, Oct. 2009.

Murdoch, J. L. et al.; Enhanced Oceanic Operations Human-In-The-Loop In-Trail Procedure Validation Simulation Study, NASA/TP-2008-215313, Jun. 2008.

Jones, K.M.; ADS-B In-Trail Procedures, Overview of Research Results; National Aeronautics and Space Administration; Presented to the ASAS TN2 Workshop, Sep. 2007.

Alam, S, et al.; An Assessment of BADA Fuel Flow Methodologies for In-Trail Procedure Evaluation; Defence & Security Applications Research Centre, University of New South Wales, Australian Defence Force Academy, Canberra, Australia.

Munoz, C.A. et al.; In-Trail Procedure (ITP) Algorithm Design; National Institute of Aerospace; Hampton, VA.

Richards, W.R. et al.; New Air Traffic Surveillance Technology; www.boeing.com/commercial/aeromagazine.

Chartrand et al.; Operational Improvements form the In-Trail Procedure in the North Atlantic Organized Track System; American Institure of Aeronautics and Astronautics.

Federal Aviation Administration; NextGen Operator and Airport Enablers; Supplement to NextGen Investment for Operators and Airports, FAA's NextGen Implementation Plan, Mar. 2011.

USPTO Office Action for U.S. Appl. No. 12/774,513; Notification date May 2, 2012.

USPTO Notice of Allowance for U.S. Appl. No. 12/721,146; notification date Jun. 7, 2012.

USPTO Final Office Action for U.S. Appl. No. 12/774,513; notification date Aug. 30, 2012.

USPTO Office Action for U.S. Appl. No. 13/407,475; notification date Nov. 21, 2012.

EP Examination Report for EP 11 154 857.4, dated May 22, 2012.

Koeners, J.; deVries, M.; Delft University of Technology, Delft, The Netherlands; Conflict Resolution Support for Air Traffic Control Based on Solution Spaces: Design and Implementation; 2008 IEEE.

EP Search Report dated May 6, 2013 for application No. EP 11 154 900.2.

* cited by examiner

SYSTEM AND METHOD FOR DISPLAYING DEGRADED TRAFFIC DATA ON AN IN-TRAIL PROCEDURE (ITP) DISPLAY

TECHNICAL FILED

Embodiments of the subject matter described herein relate generally to avionics display systems. More particularly, embodiments of the subject matter described herein relate to a system and method for displaying symbology on an In-Trail Procedure (ITP) display representative of intruder aircraft having navigational accuracy below current standards for display.

BACKGROUND

While there is little or no radar in oceanic regions, there occur a vast number of flights over such regions. For example, on a typical day, hundreds of flights cross the North Atlantic, most of which operate on standard routes. In addition to a large number of aircraft operating in an oceanic environment, the majority of flights occur during a relatively small time window primarily due to airline requests to accommodate destination airport curfew restrictions and customer convenience. Thus, many flights operate on similar routes around the same time resulting in local congestion.

Since most flights are made by similar aircraft, there is a large demand for similar crossing altitudes. The result is that some aircraft must fly at other than optimal altitudes, possibly resulting in fuel inefficiency. While there are aircraft that would occasionally climb or descend to more optimum altitudes during an oceanic crossing, such transitions are made difficult by (1) large separation requirements, and (2) limited local surveillance for identifying spaces at more desirable altitudes into which an aircraft could climb or descend.

Automatic Dependent Surveillance Broadcast (ADS-B) is a surveillance technique based on the capability of aircraft to automatically and periodically transmit data such as position, altitude, velocity, and aircraft identification. The information can be received by ground stations and other aircraft. It is precise because it relies on a GPS source and has a high refresh rate thus providing improved traffic awareness in the cockpit.

Through the use of ADS-B and ITP procedures, altitude changes are enabled that were previously blocked due to current aircraft separation minima standards; the standard separation is required between all aircraft at the current desired altitudes. The result is reduced fuel burn and $CO_2$ emissions because ITP enables aircraft to achieve flight level changes more frequently because ITP permits climbs and descents using new reduced longitudinal separation standards.

Aircraft traffic is displayed on a cockpit plan mode display and on a vertical profile display referred to as an ITP display. A pilot may plan an ITP clearance procedure (climb or descend) by viewing traffic intruders (blocking aircraft and candidate reference aircraft) on the ITP display. A blocking aircraft is one that is between the initial and desired flight levels that blocks a standard procedural level change. Reference aircraft may be one or two aircraft transmitting valid ADS-B data that meets ITP criteria and is identified to Air Traffic Control (ATC) by the aircraft considering a flight level change as part of the ITP clearance request. However, the ITP display shows only similar track traffic intruders equipped with ADS-B OUT and transmitting ADS-B OUT data within prescribed navigational accuracy limits. If the ADS-B OUT data of the traffic intruder has dropped off for some reason or has navigational accuracy (e.g. position, vertical velocity) parameters that fall below prescribed limits, the intruder will not be represented on the ITP vertical profile display and are considered as degraded traffic. In addition, pure TCAS (Traffic Collision Avoidance System) intruders that are either blocking (an aircraft that is between the initial and desired flight levels and blocks a standard procedural level change) or non-blocking will not be represented on the ITP display.

Considering the foregoing, it would be desirable to provide an aircraft display system and method for displaying intruder aircraft exhibiting navigational accuracy parameters below prescribed limits (i.e. navigational uncertainty) in the ITP display. It is also desirable to provide an aircraft system and method for displaying ADS-B equipped intruder aircraft whose ADS-B data has dropped off. It is further desirable to provide an aircraft display system and method for displaying intruder aircraft not equipped with ADS-B but equipped with TCAS alone. Furthermore, other desirable features and characteristics will become apparent from the following detailed description and the appended claims taken in conjunction with the accompanying drawings and this background of the invention.

BRIEF SUMMARY

A method for displaying degraded traffic data from an intruder aircraft on ITP display is provided. The method involves determining if the traffic data exhibits navigational accuracy insufficient for display on the ITP display and is considered as degraded. The method continues by analyzing the degraded traffic data to determine the ITP parameters for similar track traffic and to determine if the navigational accuracy of the degraded traffic data is within predefined bounds if the navigational accuracy of the degraded traffic is not sufficient for display on the ITP display.

Also provided is a method for displaying degraded traffic data from an intruder aircraft (1) that is not ADS-B equipped, (2) ADS-B out equipped intruder whose ADS-B data has dropped off, or (3) that is transmitting degraded ADS-B data. The method involves determining the accuracy and integrity of the TCAS data if the intruder aircraft is not ADS-B equipped, correlating TCAS data with previously received ADS-B data if the ADS-B data has dropped off, correlating TCAS data with degraded ADS-B data, and determining if the traffic data exhibits navigational accuracy insufficient for display on the ITP display. The method continues by analyzing the degraded traffic data to determine the ITP parameters for similar track traffic and to determine if the navigational accuracy of the degraded traffic data is within predefined bounds if the navigational accuracy of the degraded traffic is not sufficient for display on the ITP display.

An aircraft display system configured to display degraded traffic data on an ITP display is also provided. The system comprises a monitor, and a processor coupled to the monitor and configured to determine if the traffic data exhibits navigational accuracy sufficient for display on the ITP display, and, if the navigational accuracy of the traffic data is not sufficient for display on the ITP display, analyze the degraded traffic data to determine the ITP parameters for similar track traffic and to determine if the navigational accuracy of the degraded traffic data is within predefined bounds if the navigational accuracy of the degraded traffic is not sufficient for display on the ITP display.

BRIEF DESCRIPTION OF THE DRAWINGS

A more complete understanding of the subject matter may be derived from the following detailed description taken in conjunction with the accompanying drawings, wherein, like reference numerals denote like elements, and.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Techniques and technologies may be described herein in terms of functional and/or logical block components and with reference to symbolic representations of operations, processing tasks, and functions that may be performed by various computing components or devices. Such operations, tasks, and functions are sometimes referred to as being computer-executed, computerized, software-implemented, or computer-implemented. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

As stated previously, ITP is designed for oceanic and remote airspaces not covered by radar. It enables aircraft to achieve flight level changes on a more frequent basis because ITP climbs and descents are made using new reduced separation standards. This results in lower fuel consumption, fewer $CO_2$ emissions, and increased safety.

Figure 1:
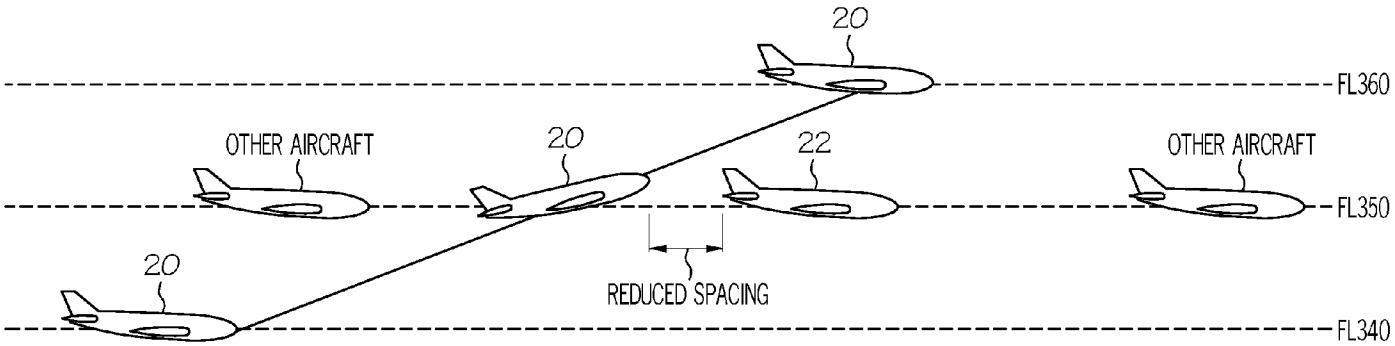
FIG. 1 is a vertical view illustrating a basic ITP procedure.

FIG. 1 is a vertical profile view illustrating a basic ITP procedure. In this case, aircraft 20 (i.e. the ITP aircraft) is seeking approval of an ITP procedure to climb from an initial flight level (FL340) through an intervening flight level (FL350) to desired flight level (FL360). However, before an ITP maneuver can take place, all ITP criteria must be met. These criteria include, but are not limited to (1) a maximum of two reference aircraft 22, only one of which is identified in FIG. 1 (i.e. aircraft with valid ADS-B data that meets ITP standards and are identified to Air Traffic Control (ATC) by the ITP aircraft as part of the ITP request); (2) reference aircraft 22 must send qualified ADS-B data; (3) the reference aircraft must be 2000 ft or less from the ITP aircraft 20; (4) the ITP distance must be not less than fifteen NM (nautical miles) with a maximum closing GS (ground speed) differential of twenty knots, or less than twenty NM with a maximum closing GS differential of thirty knots; the climb/descent must be conducted at a rate no less than 300 feet per minute; (6) the ITP and reference aircraft must be on the same track; (7) procedural separations with other aircraft (i.e. an aircraft other than the ITP or reference aircraft) are met at all flight levels between the initial flight level and the desired flight level; and (8) the ITP aircraft must not be a reference aircraft in another ITP clearance request. Thus if the reference aircraft is not transmitting valid ADS-B data or does not satisfy other ITP criteria, the requested ITP maneuver will not be approved.

Figure 2:
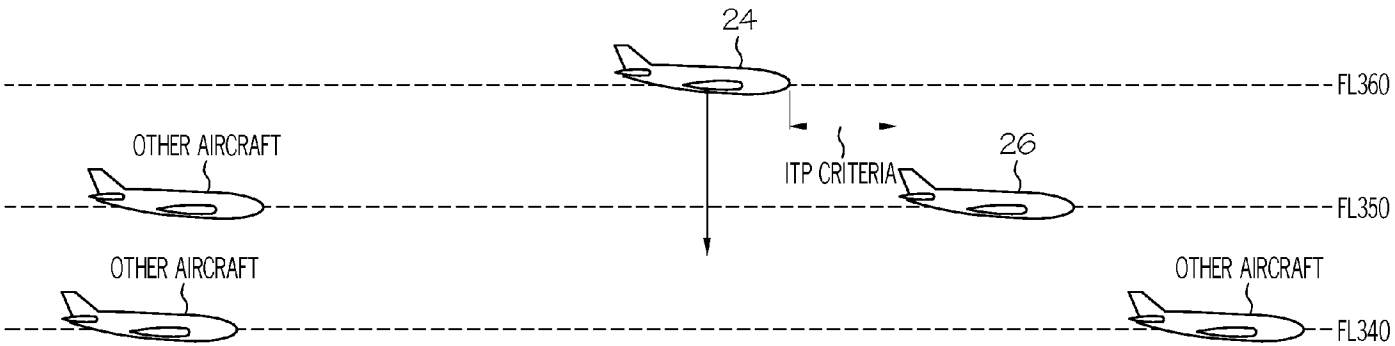
FIG. 2 is a vertical view illustrating the situation when a blocking aircraft is not transmitting ADS-B data under current standards.

Traffic is shown on a plan mode display (e.g. a traffic situational awareness display) and on the vertical profile ITP display. By viewing the location of traffic intruders (i.e. blocking and candidate reference aircraft), a pilot may plan for an ITP procedure. However, as previously stated, only similar track intruders equipped with ADS-B OUT and transmitting ADS-B OUT data within prescribed navigational accuracy limits will be displayed on the ITP display. If an intruder aircraft's ADS-B OUT data has dropped off or its navigational accuracy (position, vertical velocity, etc.) parameters have fallen below prescribed limits, or if the intruder aircraft data is a pure TCAS intruder, these blocking or non-blocking aircraft are not represented on the ITP vertical display. For example, in FIG. 2, if blocking aircraft 26 flying at FL350 is unable to or not equipped to transmit valid ADS-B OUT data, it is not represented on the ITP vertical display. Thus, the pilot of the ownship 24 loses situational awareness of blocking aircraft 26, which may resulting in (1) the pilot of aircraft 24 initiating an ITP request that may result in a rejection form ATC; and (2) upon recovering the rejection, the pilot would only know that there is traffic on the desired flight level or intervening flight level that does not satisfy the standard longitudinal separation minima, but would not know the placement of traffic because it is not displayed on the ITP display.

Embodiments disclosed herein relate to systems and methods for displaying on an ITP display (1) ADS-B equipped intruder aircraft whose ADS-B out has failed to transmit its data; (2) intruder aircraft exhibiting navigational uncertainty below standard prescribed limits; and/or (3) intruder aircraft equipped with TCAS but not ADS-B.

Figure 3:
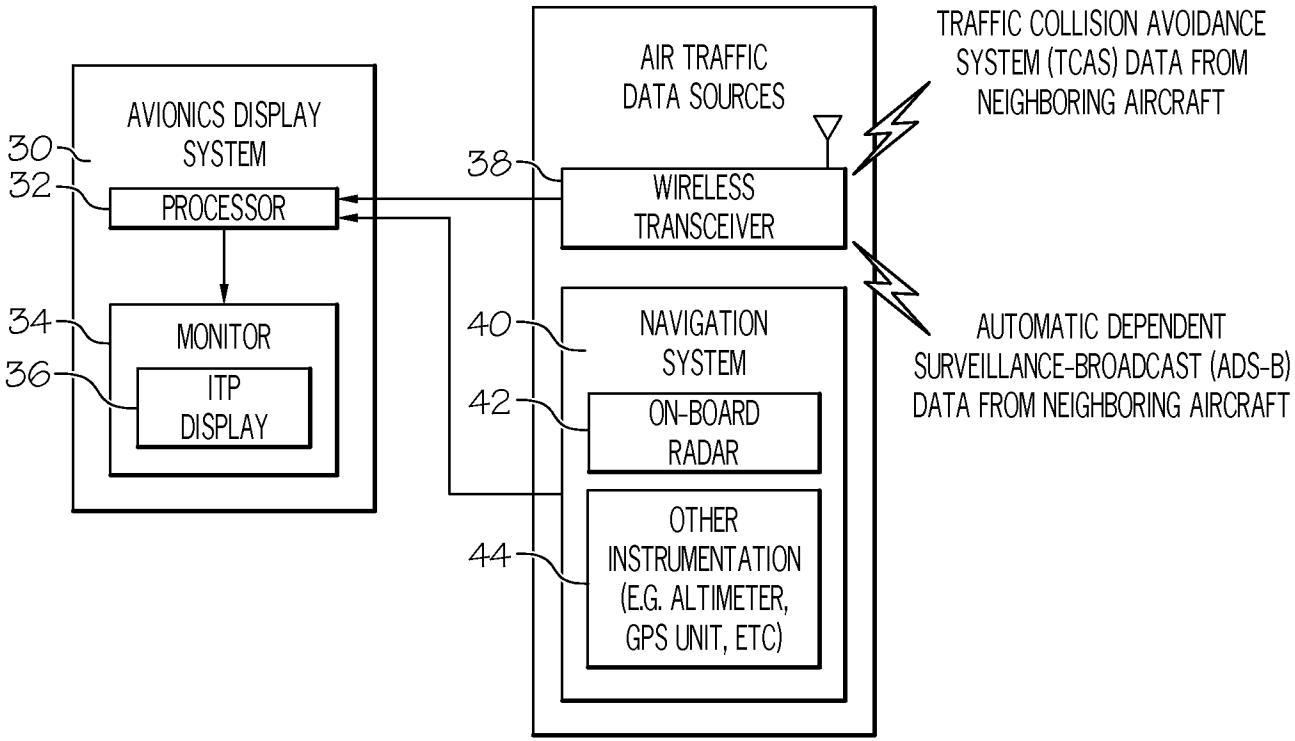
FIG. 3 is a block diagram of a generalized avionics display system in accordance with an exemplary embodiment.

FIG. 3 is functional block diagram that includes a generalized avionics display system 30 in accordance with an exemplary embodiment. Avionics display system 30 includes at least one processor 32 and at least one monitor 34, which is operatively coupled to processor 32. During operation of avionics display system 30, processor 32 drives monitor 34 to produce a graphical display 36 that visually provides a pilot and crew with navigational informational pertaining to the host aircraft and to neighboring aircraft within a predetermined vicinity of the host aircraft. Graphical display 36 may include visual representations of one or more of flight characteristics pertaining to a neighboring aircraft, as described more fully below. Processor 32 may generate display 36 in a two dimensional format (e.g., as a moving map display), in a three dimensional format (e.g., as a perspective display), or in a hybrid format (e.g., in a picture-in-picture or split screen arrangement). More specifically, display 36 maybe a vertical profile ITP display Processor 32 may comprise, or be associated with, any suitable number of individual microprocessors, flight control computers, navigational equipment, memories, power supplies, storage devices, interface cards, and other standard components known in the art. In this respect, the processor 32 may include or cooperate with any number of software programs (e.g., avionics display programs) or instructions designed to carry out the various methods, process tasks, calculations, and control/display functions described below.

Image-generating devices suitable for use as monitor 34 include various analog (e.g., cathode ray tube) and digital (e.g., liquid crystal, active matrix, plasma, etc.) display devices. Monitor 34 may be disposed at various locations throughout the cockpit, but preferably reside at a central location within the pilot's primary field-of-view. Alternately, monitor 34 may be mounted at a location for convenient observation by the aircraft crew.

Processor 32 includes one or more inputs operatively coupled to one or more air traffic data sources. During operation of display system 30, the air traffic data sources continually provide processor 32 with navigational data pertaining to neighboring aircraft. In the exemplary embodiment illustrated in FIG. 3, the air traffic data sources include a wireless transceiver 38 and a navigation system 40, which are operatively coupled to first and second inputs of processor 32, respectively. Navigation system 40 includes an onboard radar 42 and various other onboard instrumentation 44, such as a radio altimeter, a barometric altimeter, a global positioning system (GPS) unit, and the like.

With continued reference to FIG. 1, wireless transceiver 38 is considered an air traffic data source in that transceiver 38 receives navigational data from external sources and relays this data to processor 32. For example, wireless transceiver 38 may receive Traffic Collision Avoidance System (TCAS) data and Automatic Dependent Surveillance-Broadcast (ADS-B) data from neighboring aircraft. TCAS data, ADS-B data, and other such external source data are preferably formatted to include air traffic state vector information, which may be utilized to determine a neighboring aircraft's current position and velocity. Furthermore, in accordance with embodiments disclosed herein, processor 32 is configured to determine if degraded traffic data meets predetermined minimum standards of navigational certainty and permit such traffic to be displayed on the vertical profile ITP display that is not displayed under current ITP standards, thus increasing a pilot's situational awareness.

Figure 4:
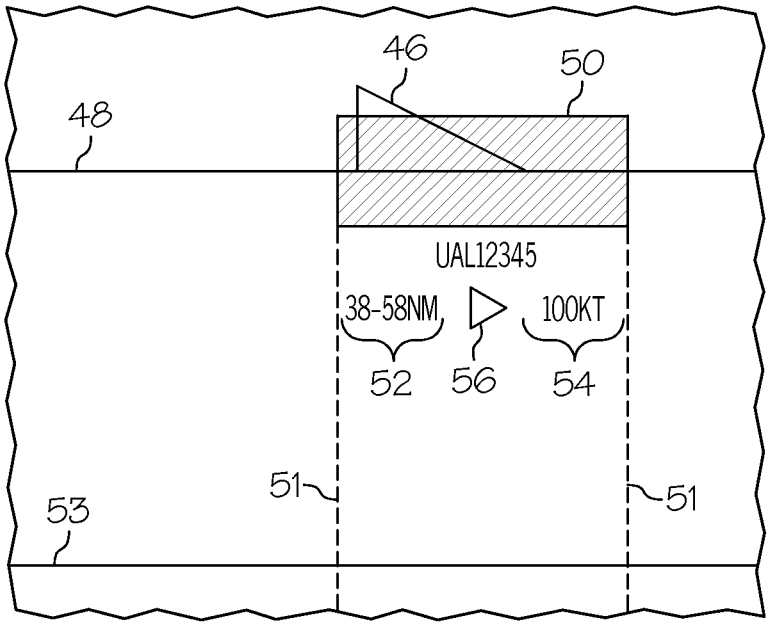
FIG. 4 illustrates an embodiment of a first symbology scheme for graphically displaying degraded traffic data on an ITP display.

FIG. 4 illustrates a traffic display graphic that may be generated by processor 32 for display on ITP display 36 and visually represents an intruder aircraft having degraded navigational data and position uncertainty. As can be seen, the graphic illustrates (1) a traffic symbol 46 visually representing an intruder aircraft on flight level 48; (2) a graphical representation of uncertainty on the ITP scale (i.e. a shaded or transparent rectangle 50 having a length visually representative of plus or minus the radius of containment (±Rc)) and wherein the height is visually representative of 200 feet; and (3) a textual representation of uncertainty 52 on the ITP scale represented by a maximum value equal to the ITP distance plus Rc and the minimum of which is the ITP distance minus Rc where Rc is mapped to the ITP distance scale and is derived from the containment mapping table discussed below. If two aircraft, A and B, have the same ground track, the ITP distance is the distance between A and B on their ground track. If the two aircraft, A and B, have ground tracks that intersect at an common point X and at an angle of less than forty-five degrees, then the ITP distance is the absolute value of the distance of aircraft A to common point X minus the distance of aircraft B to common point X, if the aircrafts are approaching point X. Otherwise, the ITP distance is the absolute value of the distance of aircraft A to common point X plus the distance of aircraft B to common point X, if the aircrafts are moving away from the common point X.

Referring again to FIG. 4, the graphic for display on the ITP also includes a textual representation of ground speed 54 and a symbol 56 that provides a visual indication of whether the ownship and the intruder are separating or closing in the manner in which these parameters have been previously displayed in connection with ITP traffic displays.

FIGS. 5, 6, 7 and 8 are flowcharts corresponding to three scenarios for generating degraded traffic symbology in processor 32 for display by monitor 34 on ITP display 36. The first scenario corresponds to the presence of a traffic intruder that is not transmitting ADS-B data or whose ADS-B data has dropped off. This is accomplished by correlating the intruder's TCAS data received using secondary surveillance radar and previously received and stored ADS-B data. In this manner, the position, track, and velocity of the intruder can be extrapolated. The traffic intruder's navigational accuracy for the new values can thus be determined. The second scenario occurs when the intruder is not equipped with ADS-B OUT. In this case, navigational accuracy is determined using TCAS data. The third scenario involves aircraft equipped with older installations of ADS-B OUT (e.g. DO-260, DO-260A) having navigational accuracy less than that required to qualify for display on ITP vertical display 36.

In each of these scenarios, if the accuracy of the navigational parameters is less than prescribed by current standards, the traffic is considered degraded traffic. That is, if the navigational accuracy category for position (NACp) is less than five, or the navigation integrity category (NIC) is less than five, or the navigation accuracy category for velocity (NACv) is less than one, the intruder is considered degraded traffic and is not displayed on the ITP display. However, the representation of degraded traffic intruders is considered useful if they are on a similar track with respect to the ownship, their longitudinal separation is less than the default standard longitudinal separation limit, and their uncertainty is within predefined bounds. Information relating to the maximum and minimum uncertainty in ITP distance may be shown using vertical lines dropping onto the ITP distance scale.

Figure 5:
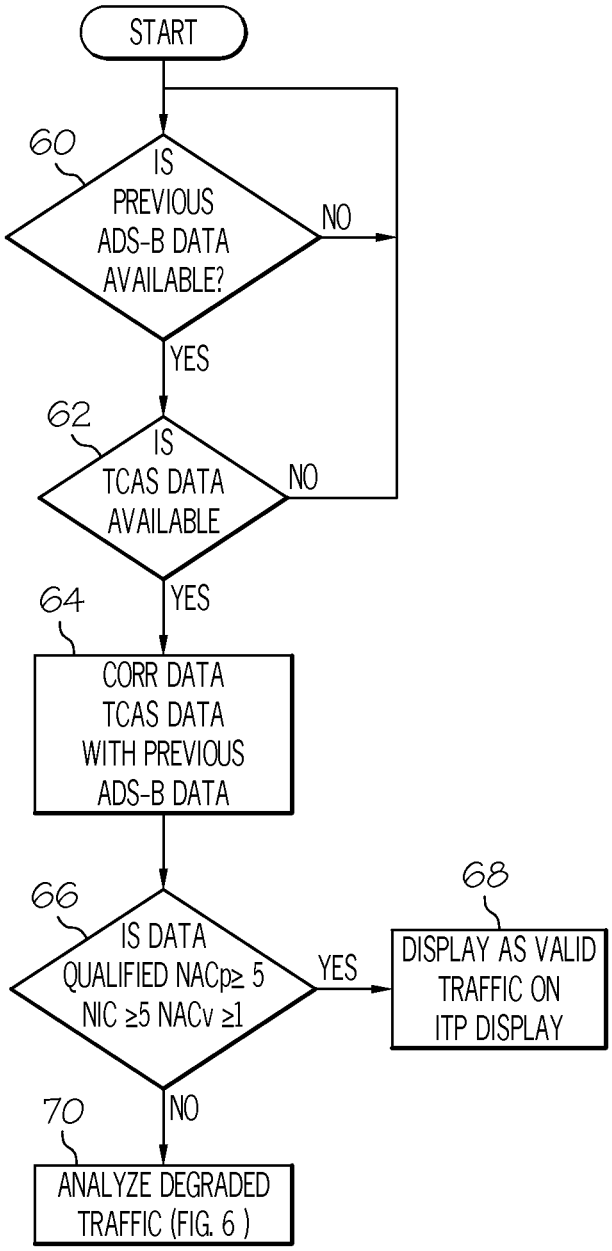
FIGS. 5, 6, 7, and 8 are flowcharts illustrating a method for generating and displaying degraded traffic symbology on an ITP display.
Figure 6:
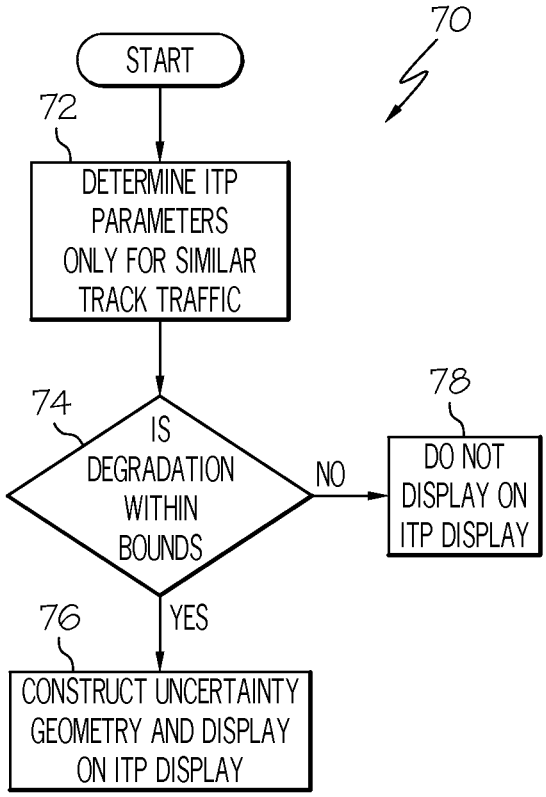

FIGS. 5 and 6 are flowcharts describing a method that may be carried out by the system shown and described in connection with FIG. 3 that for displaying symbology on an ITP display representative of an intruder aircraft when the intruder's ADS-B data is not being transmitted or, for some reason, has dropped off.

Referring specifically to FIG. 5, after determining that ADS-B data is not being received, the process commences by determining if there is a history of ADS-B data previously received and stored (STEP 60). If such is the case, and the intruder aircraft is transmitting TCAS data (STEP 62), the TCAS data is correlated with the previously stored ADS-B data (STEP 64). That is, processor 32 utilizes the relationship between TCAS data and previously received ADS-B data to generate and store a table or other multi-dimensional representation of the database of information. Processor 32 then compares the currently received TCAS data with previously stored ADS-B data to more accurately determine the navigational parameters, including averaging the TCAS data and previously received ADS-B data and associating the TCAS data with the previously received and stored ADS-B data. A technique of this type is described in more detail in US2008/0120032 A1 published May 22, 2008 and entitled "Methods and Systems of Determining Bearing when ADS-B Data is Unavailable."

Next, in STEP 66, a determination is made as to whether or not the data meets certain navigational requirements for example, is (1) the navigation accuracy category for position (NACp) equal to or greater than five, (2) the navigation integration category equal to or greater than five, and (3) the navigation accuracy category for velocity (NACv) equal to or greater than one. If these conditions are met, the intruder is displayed as valid traffic on the ITP display (STEP 68) or otherwise the intruder is considered as degraded traffic. If these conditions are not met, the degraded traffic is further analyzed (STEP 70) using the process described in connection with the flowchart shown in FIG. 6.

Referring to FIG. 6, the ITP parameters such as ITP distance, relative track, and altitude for similar track traffic are determined (STEP 72) in processor 32 from ADS-B reports, TCAS data, or both. The ITP distance is described above. Similar track is defined as an instantaneous track that is identical, parallel, or one which converges or diverges at less than forty-five degrees or more than 315 degrees. An aircraft is considered a blocking aircraft only if the relative track of the ownship and traffic intruder meet this "similar track" criteria.

In STEP 74, a determination is made as to whether or not the degradation of the data is within predefined bounds. That is, is the navigation accuracy for position (NACp) is equal to or greater than the lowest acceptable value of NACp that will be considered for display on the ITP display. This is determined using a containment mapping table derived from Standards (DO-312) and stored in processor 32 that describes the radius of containment (NIC) for any value of NACP. The ITP distance of the traffic calculated above (STEP 72) can vary within the radius of containment. If the degradation is within bounds, the uncertainty geometry described above in connection with FIG. 4 will be generated and displayed on ITP display 36 (STEP 76). As previously stated, the information regarding maximum and minimum uncertainty is shown with vertical lines 51 dropping onto the ITP distance scale 53 in FIG. 4. If the degradation is not within bounds, the data will not be displayed (STEP 78).

Figure 7:
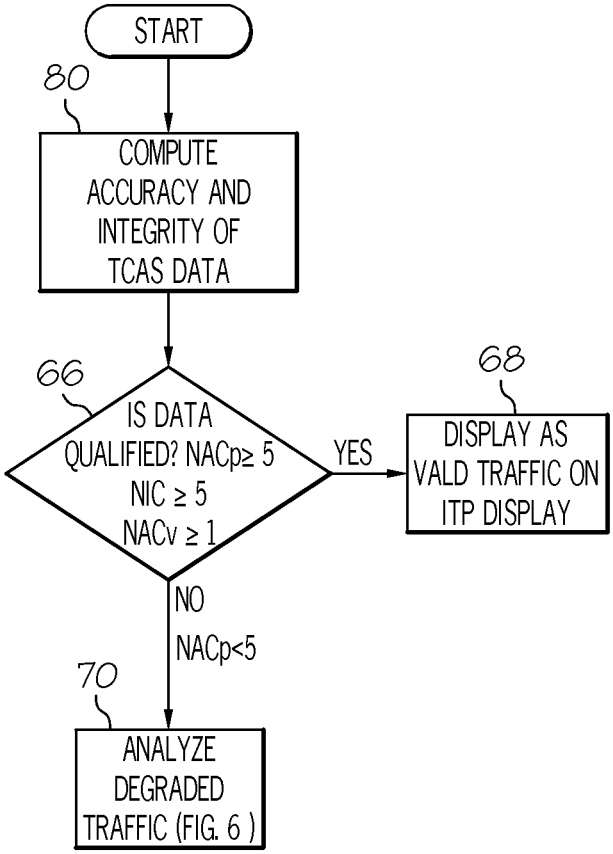
Figure 8:
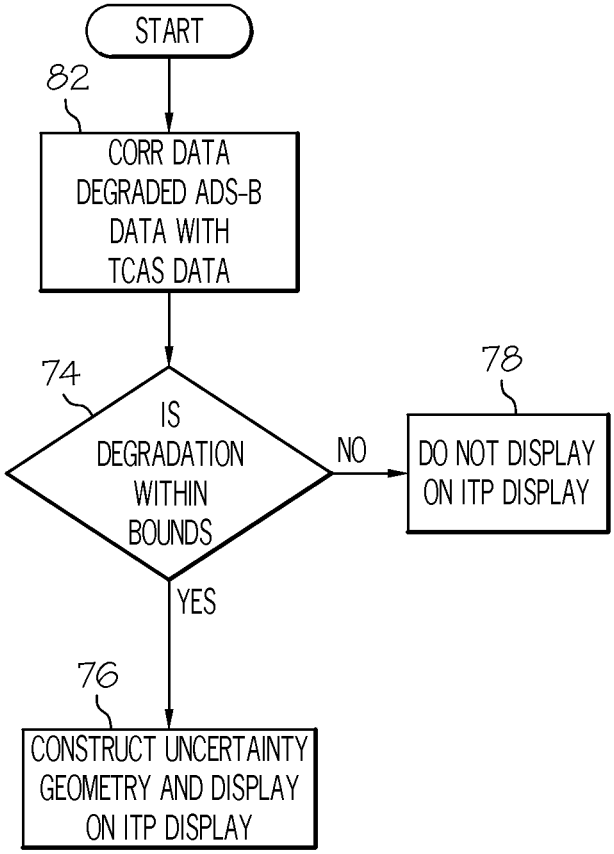

Referring to FIG. 7, if the traffic intruder is not equipped with ADS-B, the navigational accuracy and integrity of the TCAS data is computed by the TCAS system as is shown at STEP 80. The rest of the process for displaying degraded TCAS data is that shown in STEPS 66, 68, and 70 described in connection with FIG. 5 and STEPS 72, 74, 76, and 78 described in connection with FIG. 6.

A third scenario arises when an intruder is equipped with an older ADS-B system (e.g. DO-260, DO-260A) having navigational accuracy less than that required under current standards for qualifying to be displayed on the ITP vertical display. Referring to the flowchart shown in FIG. 8, degraded ADS-B data is correlated with TCAS data in STEP 82 using techniques described above in connection with STEP 64 in FIG. 5. The rest of the process for displaying degraded ADS-B data is the same as STEPS 66, 68, and 70 in FIG. 5 and thus, the STEPS 72, 74, 76, and 78 shown and described in connection with FIG. 6.

Thus, there has been provided an aircraft display system and method for displaying intruder aircraft exhibiting navigational accuracy parameters below prescribed limits (i.e. navigational uncertainty) in the ITP display providing a pilot with greater situational awareness.

What is claimed is:

1. A method for displaying degraded traffic data from an intruder aircraft on an ITP display, comprising:

determining if the traffic data exhibits navigational accuracy sufficient for display on the ITP display; and if the navigational accuracy of the traffic is not sufficient for display on the ITP display, analyze the degraded traffic data to determine the ITP parameters for similar track traffic and to determine if the navigational accuracy of the degraded traffic is within predefined bounds.

2. A method according to claim 1 wherein the step of determining comprises correlating TCAS data with previously stored ADS-B data.

3. A method according to claim 1 wherein the step of determining comprises checking the accuracy and integrity of TCAS data if there is no ADS-B data.

4. A method according to claim 1 wherein the step of determining comprises correlating TCAS data with degraded ADS-B data.

5. A method according to claim 1 wherein the step of analyzing comprises:

determining ITP parameters for similar track traffic; and displaying the degraded traffic if the degradation is within predefined bounds.

6. A method according to claim 5 wherein the step of displaying comprises constructing and displaying uncertainty graphics.

7. A method according to claim 6 wherein the uncertainty graphics comprise a graphical representation of uncertainty.

8. A method according to claim 7 wherein the graphical representation on the ITP vertical display comprises a rectangle having a length and a height.

9. A method according to claim 8 wherein the graphical representation comprises a textual representation of uncertainty including text visually representative of the length.

10. A method according to claim 9 wherein the ITP display comprises an ITP distance scale and wherein the uncertainty graphics comprise vertical lines extending to the ITP distance scale and representing the minimum and maximum uncertainty in ITP distance.

11. A method according to claim 1 wherein the step of determining comprises determining if NACp is equal to or greater than five, NIC is equal to or greater than five, and NACv is equal to or greater than one.

12. A method for displaying degraded traffic data from an intruder aircraft that is not ADS-B equipped, whose ADS-B data has dropped off, or is transmitting degraded ADS-B data, the method comprising:

determining the accuracy and integrity of the TCAS data if the intruder aircraft is not ADS-B equipped;

correlating TCAS data with previously received and stored ADS-B data if the ADS-B data has dropped off;

correlating TCAS data with degraded ADS-B data if the aircraft is transmitting degraded ADS-B data;

determining if the traffic data exhibits navigational accuracy sufficient for display on the ITP display; and analyzing the degraded traffic data to determine the ITP parameters for similar track traffic and to determine if the navigational accuracy of the degraded traffic data is within predefined bounds.

13. A method according to claim 12 wherein the step of analyzing comprises:

determining ITP parameters for similar track traffic; and displaying the degraded traffic if the degradation is within the predefined bounds.

14. A method according to claim 13 wherein the step of displaying comprises constructing and displaying uncertainty graphics.

15. A method according to claim 14 wherein the uncertainty graphics comprise a graphical representation of uncertainty and a textual representation of uncertainty.

16. A method according to claim 15 wherein the graphical representation of uncertainty comprises a rectangular symbol having a length and a height, and the textual representation of uncertainty comprises text visually representative of the numeric value of the length of the graphical representation of uncertainty.

17. An aircraft display system configured to display degraded traffic data on an ITP display, comprising:

a monitor; and a processor coupled to the monitor and configured to determine if the traffic data exhibits navigational accuracy sufficient for display on the ITP display, analyze the degraded traffic data to determine the ITP parameters for similar track traffic, and determine if the navigational accuracy of the degraded traffic data is within predefined bounds if the navigational accuracy of the degraded traffic is not sufficient for display on the ITP display.

18. An aircraft display system according to claim 17 wherein the processor is configured to generate a graphical representation of uncertainty on the monitor.

19. An aircraft display system according to claim 17 wherein the processor is configured to generate a textual representation of uncertainty on the monitor.

20. An aircraft display system according to claim 18 wherein the graphical representation of uncertainty on the ITP vertical display is a rectangle.

* * * * *